United States Patent [19]

Buzek et al.

[11] Patent Number: 4,493,618

[45] Date of Patent: Jan. 15, 1985

[54] HANDLE FOR COMPRESSOR UNITS

[76] Inventors: Eric W. Buzek; Eileen M. Buzek; Frank R. Buzek, all of 6337 Willowdale, Houston, Tex. 77087

[21] Appl. No.: 485,460

[22] Filed: Apr. 18, 1983

[51] Int. Cl.[3] ..... F04B 21/00

[52] U.S. Cl. ..... 417/234; 417/902

[58] Field of Search ..... 417/234, 902

[56] References Cited

U.S. PATENT DOCUMENTS

| | | | |
|---|---|---|---|
| 2,685,404 | 8/1954 | Wohlmeyer | 417/234 |
| 2,812,895 | 11/1957 | Peeps | 417/234 |
| 4,281,922 | 8/1981 | Jacobs | 417/902 |

FOREIGN PATENT DOCUMENTS

| | | | |
|---|---|---|---|
| 837209 | 6/1960 | United Kingdom | 417/234 |

*Primary Examiner*—Carlton R. Croyle
*Assistant Examiner*—Peter M. Cuomo
*Attorney, Agent, or Firm*—James Monroe Harris

[57] ABSTRACT

A novel handle means for compressor units adapted to appropriately engage the charge, discharge, and suction outlets of a standard, lightweight, portable compressor unit. Semi-rigid tubing, e.g. copper tubing, is appropriately contoured about the body of a standard compressor unit to form a handle means with which the compressor unit may be conveniently transported. The novel configuration of the handle means herein disclosed conveniently positions the suction, charge and discharge outlets of a compressor unit for convenient connection with appropriate hose attachments.

3 Claims, 2 Drawing Figures fig.2
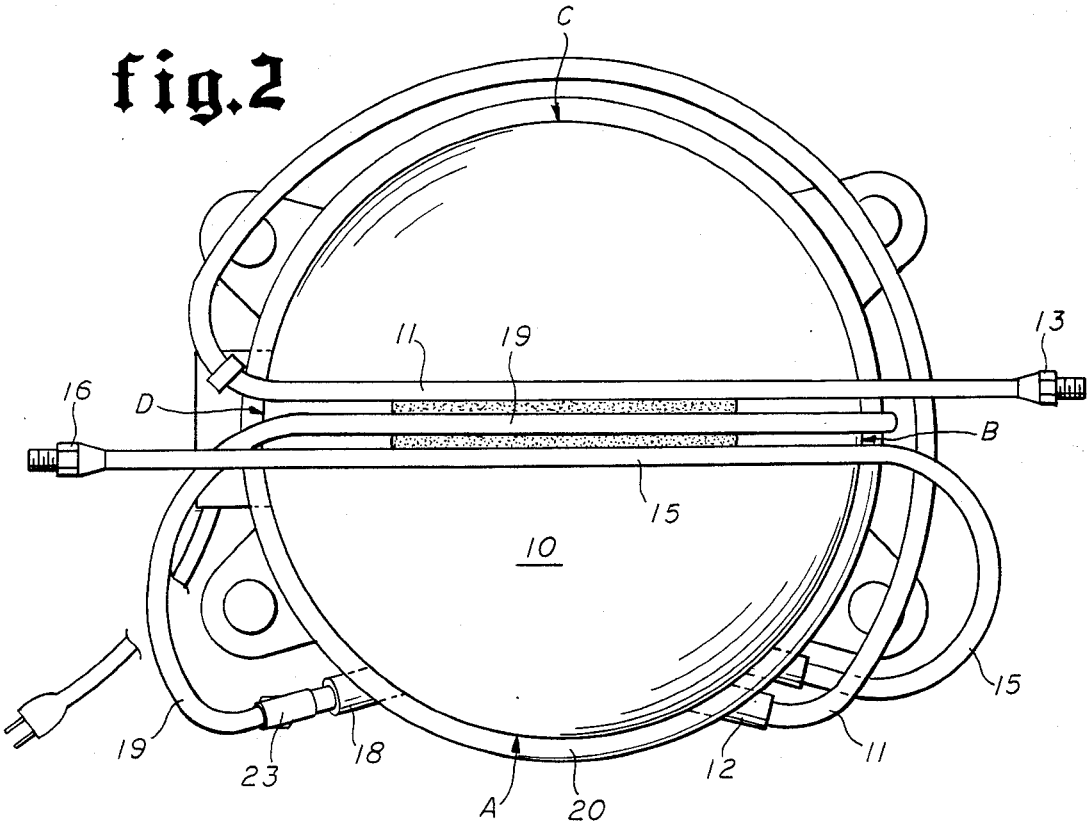
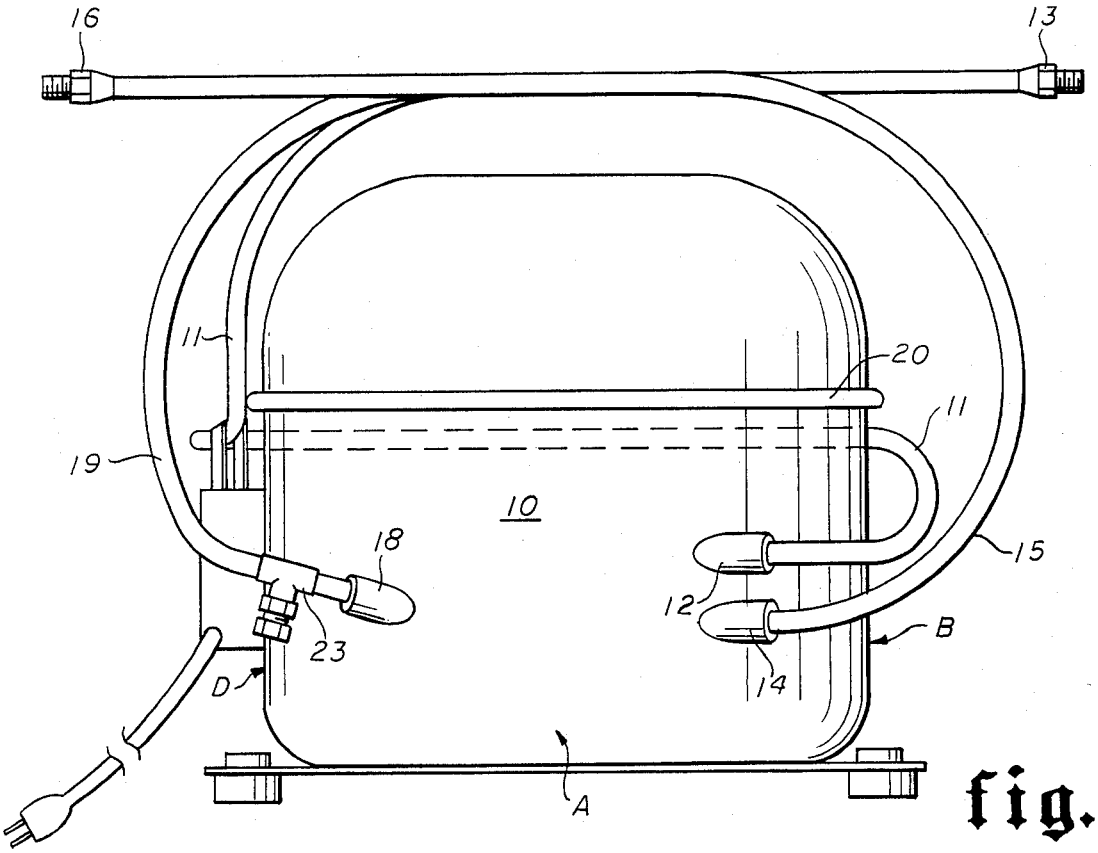
fig.1

HANDLE FOR COMPRESSOR UNITS

BACKGROUND OF THE INVENTION

This invention relates a novel handle means for portable air compressor units. More particularly, the present invention relates to a novel arrangement of semi-rigid tubing about the body of a portable air compressor unit, the arrangement forming a handle means with which the compressor unit may be easily transported. Still more particularly, the present invention relates to a novel arrangement of tubing about the body of an air compressor unit, the arrangement forming a handle means and in so doing conveniently disposing the suction, charge and discharge connections for engagement with hose attachments.

The prior art is replete with lightweight, standard refrigeration compressors, most of which are adapted to be mounted on a stationary base.

When portable units have been revealed, as in U.S. Pat. No. 2,685,404 or British Pat. No. 606,378, they have detailed expensive, complex and often bulky means with which to transport the compressor unit.

SUMMARY OF THE INVENTION

It is therefore the primary object of the present invention to provide a novel handle means useful in the transportation of certain air compressor units which are adaptable thereto.

It is a further object of this invention to provide a handle means having a novel configuration which incorporates the vacuum discharge, and charge functions of a compressor unit therein.

It is yet another object of this invention to provide a handle means to transport a compressor unit which is inexpensive, simple in design, and readily attachable to a number of standard compressor units with little or no modification being made thereto.

These and other objects of the present invention will be best understood from a consideration of the following detailed description taken in connection with the accompanying drawings which form part of the specification, with the understanding, however, that the invention is not confined to a strict conformity with the drawings, but may be changed or modified so long as such changes or modifications mark no material departure from the salient features of the invention as expressed in the appended claims.

BRIEF DESCRIPTION OF THE DRAWINGS

FIG. 1 is a side view of a standard, lightweight, electric compressor unit with the present invention attached thereto.

FIG. 2 is a top view of a standard, lightweight, electric compressor unit with present invention attached thereto.

DESCRIPTION OF THE PREFERRED EMBODIMENTS

As illustrated in FIGS. 1 and 2, the tubular handle means of the present invention and a standard refrigeration compressor are shown in engaged position. Such illustrations are useful in depicting the utility of the present invention and are shown for purposes of convenience in understanding the operation and function of the invention herein disclosed.

The numeral 10 generally designates a standard refrigeration compressor. The suction connection of this compressor is indicated by the numeral 12. In the formation of the novel and useful handle means of the present invention a length of tubing 11 is appropriately connected to the suction outlet 12 of a standard refrigeration compressor 10. Illustratively, the suction outlet 12 is disposed beneath the divided well 20 of the compressor 10 on that side of the compressor depicted as side A near its right extremity (FIG. 2). The tubing connected to the suction outlet 12 extends laterally and upwardly in a counterclockwise fashion along the lower part of side A. Such tubing continues to extend laterally and upwardly around side B making a 180° turn from the suction connection 12 on side A, until it reaches a point immediately beneath the divided well 20 near the far extremity of side B. From side B, it extends laterally under the divided well 20 along side C. From side C the tubing extends laterally to side D where it turns upwardly toward the top of the compressor until it reaches a point about 2 inches above the top of the compressor. There the suction outlet tubing 11 makes a 160° turn and extends horizontally across the center of the compressor 10, along the compressors length, and then beyond and above the suction outlet tubing's encirclement of side B to a point where the tubing 11 extends approximately 3 inches beyond the body of the compressor 10 and terminates. Attached to the terminal end of the suction outlet tubing 11 is a valve core connection 13 suitably adapted to engage appropriate hose connections.

The discharge outlet of the compressor unit 10 is indicated by the numeral 14 (FIG. 1). This outlet is situated immediately beneath the suction outlet 12 on the body of the compressor unit 10. Tubing 15, appropriately connected to the discharge outlet 12, extends laterally and upwardly along side A until it reaches a point about half-way around side B. There it extends upwardly toward the top of the compressor unit 10 until it reaches a point about 2 inches above the top of the compressor. Then it extends horizontally (FIG. 2) across the center of the compressor unit, along the compressor's length, parallel to, but on the far side of the tubing 11 attached to the suction outlet 12, until it reaches a point approximately 3 inches beyond the body of the compressor unit 10 and terminates. As with tubing 11, an appropriate adaptor means 16 is disposed on the terminal end of tubing 15.

Also disposed on side A of the compressor unit 10, but at the end distant from the suction outlet 12 and discharge outlet 14, is an oil drainage outlet 18. The drainage outlet 18 of the compressor unit 10 is appropriately connected to a length of tubing 19 which extends in a clockwise manner from side A of the compressor unit 10 laterally and upwardly along side D. Near the midway point of side D the tubing 19 turns upwardly toward the top of the compressor unit until it reaches a point about 2 inches above the top of the compressor unit. There the tubing 19 turns at an angle of about 160° and extends horizontally across the center of the compressor unit, along the compressor's length, parallel to and between the suction tubing 11 and discharge tubing 15, until it reaches a point near the outer periphery of the body of the compressor unit 10.

Incorporated into the tubing 19 near the oil drainage outlet 18 is a "Tee" fitting 23. The "Tee" fitting is adapted to drain oil out of the compressor unit. The remainder of the tubing, situated beyond the "Tee" fitting serves no operative function other than to provide additional support for the handle uniquely formed by the suction tubing 11 and the discharge tubing 15.

As depicted in FIGS. 1 and 2, the oil drainage outlet 18 is disposed with a "Tee" fitting and a length of of tubing 19. It is conceivable, however, to completely plug up the oil drainage outlet 18 and attach tubing 19 to the plugged outlet 18 to form the handle while omitting inclusion of the "Tee" fitting. In such instance, the compressor unit 10 may be modified to place the oil drain elsewhere, for example, on side A of the compressor unit 10 beneath the suction and discharge outlets.

After the tubing has been conformed about the compressor unit as herein described, it is then appropriately bonded together by suitable means such as welding or the like.

In operation, the handle means of the present invention, once attached to a standard, lightweight refrigeration compressor, may be used to pump up vehicle tires and the like, or for other purposes requiring compressed air when appropriate attachments are connected to the discharge tubing adaptor 16.

Alternatively, suction tubing line 11 may be appropriately engaged to operate as a vacuum pump to evacuate air or other non-aqueous fluids from auto, home or commercial air conditioners and refrigerators.

The novel handle means herein revealed is preferably made of a semi-rigid metallic tubing, such as copper tubing or the like, of appropriate size and strength so that the handle means may easily support the weight of the compressor unit during the transportation without undergoing destructive deformation.

The handle means herein disclosed is generall compatible with standard, lightweight, "off-the-shelf" refrigeration compressors. These standard refrigeration compressors are of the 1/5 hp, $\frac{1}{4}$ hp and/or $\frac{1}{3}$ hp variety, and are produced by a number of manufacturers. While the illustrated compressor (FIG. 2) is depicted as being round in shape, the present disclosure is by no means limited to round compressors only, as the handle means is useful with compressors of a rectangular shape.

It is to be understood that the present invention is not to be taken as being limited to the accompanying drawings and specification. While a particular embodiment of the present invention has been herein illustrated and described, it is not intended to limit the invention to such disclosure, but changes and modifications may be made therein and thereto.

It is also to be understood that the phraseology and terminology herein employed are for purposes of description and not of limitation, since the scope of the present invention is denoted by the appended claims.

What is claimed is:

1. A novel handle means for standard, light-weight refrigeration compressor units, comprising:

(a) a suction line forming an integral part of said handle means, said suction line engaging the suction outlet of said compressor unit, and appropriately encircling said compressor unit to conveniently dispose said suction outlet above and beyond the body of said compressor unit for easy joinder with desired compressor attachments, (b) a discharge line forming an integral part of said handle means, said discharge line engaging the discharge outlet of said compressor unit, and appropriately encircling said compressor unit to conveniently dispose said discharge outlet above and beyond the body of said compressor unit for easy joinder with desired compressor attachments, and (c) an oil drainage outlet line, said oil drainage outlet line engaging the oil drainage outlet of said compressor unit, and appropriately encircling said compressor unit to form an integral part of said handle means, said oil drainage outlet line also being disposed with a "tee" fitting near said drainage outlet of said compressor unit so as to enable the drainage of oil from said compressor unit, said suction line, discharge line and outlet line being appropriately bonded together to form a unitary structure.

2. The handle means as described in claim 1, wherein said oil drainage outlet line beyond the side of said "tee" fitting serves as a support means.

3. The handle means as described in claim 2, wherein said handle means is made of appropriately sized copper tubing.

* * * * *